US006629319B2

(12) United States Patent
Simpson

(10) Patent No.: US 6,629,319 B2
(45) Date of Patent: Oct. 7, 2003

(54) AIR VENTILATION SYSTEM

(76) Inventor: Albert Simpson, 1129 N. Oxford Dr. #D, Redlands, CA (US) 92374

( * ) Notice: Subject to any disclaimer, the term of this patent is extended or adjusted under 35 U.S.C. 154(b) by 0 days.

(21) Appl. No.: 09/888,116

(22) Filed: Jun. 22, 2001

(65) Prior Publication Data

US 2001/0054195 A1 Dec. 27, 2001

Related U.S. Application Data

(60) Provisional application No. 60/213,437, filed on Jun. 22, 2000.

(51) Int. Cl.[7] ..... E03D 9/04
(52) U.S. Cl. ..... 4/213; 4/216
(58) Field of Search ..... 4/213, 216, 217

(56) References Cited

U.S. PATENT DOCUMENTS 3,491,382 A * 1/1970 Poister ..... 4/213
3,824,637 A * 7/1974 Hunnicutt, Jr. ..... 4/213
3,849,808 A * 11/1974 Olson et al. ..... 4/213
4,200,940 A * 5/1980 Buchanan ..... 4/213
4,617,687 A * 10/1986 Wadsworth ..... 4/213
5,253,371 A * 10/1993 Slawinski ..... 4/213
6,003,157 A * 12/1999 Bruyere ..... 4/213

* cited by examiner

*Primary Examiner*—Gregory L. Huson
*Assistant Examiner*—Amanda Flynn
(74) *Attorney, Agent, or Firm*—Matthew J. Peirce

(57) ABSTRACT

An apparatus which incorporates an air ventilation system into a standard toilet seat is disclosed. The apparatus would connect a filtration system to the rear half portion of a toilet seat by a plurality of ventilation pathways, which would connect to two primary ventilation pathways located in the rear of a toilet seat, which in turn would connect to the filtration system via a house connection. The filtration system itself would be housed in a box-like container, with the container having two major compartments, a filter compartment and a fan compartment.

2 Claims, 2 Drawing Sheets

AIR VENTILATION SYSTEM

This application claims the benefit of provisional application Ser. No. 60/213,437 filed Jun. 22, 2000.

I. BACKGROUND OF THE INVENTION

The present invention concerns that of a new and improved apparatus which incorporates an air ventilation system into a standard toilet seat.

II. DESCRIPTION OF THE PRIOR ART

U.S. Pat. No. 5,850,638, issued to Her, discloses a toilet ventilation system comprised of a vacuum assembly capable of suctioning foul odor through a plurality of ventilation ports located under a toilet seat and out a flexible tube.

U.S. Pat. No. 5,829,066, issued to Aibe, discloses a gas deodorizing system for use with a toilet.

U.S. Pat. No. 5,745,927, issued to Hoareau, discloses a lavatory bowl ventilation system activated by a switch when the toilet lid is opened.

U.S. Pat. No. 5,231,705, issued to Ragusa, discloses a system for removing gaseous odors from a toilet bowl and comprises a suction pump and a replaceable charcoal filter.

III. SUMMARY OF THE INVENTION

The present invention concerns that of a new and improved apparatus which incorporates an air ventilation system into a standard toilet seat. The present invention would connect a filtration system to the rear half portion of a toilet seat by a plurality of ventilation pathways. The plurality of ventilation pathways would connect to two primary ventilation pathways located in the rear of a toilet seat, which in turn would connect to the filtration system via a house connection. The filtration system itself would be housed in a box-like container, with the container having two major compartments, a filter compartment and a fan compartment. The filter compartment would be accessible by a user and would allow a user to place a replaceable filter. The fan compartment, separated from the filter compartment by a divider membrane, would include a fan motor, with the fan motor including a fan, belt, and an electric motor. The belt would hook up the fan to the electric motor and would ensure rotation of the fan once the electric motor would be activated. The present invention would be activated by a pressure-activated seat switch, with the switch being located on the underside of the rear half of the toilet seat. Once a user would sit down, the seat switch would complete an electrical circuit, allowing the present invention to operate. Alternatively, the present invention could be activated merely by a user turning on a light switch within a bathroom.

There has thus been outlined, rather broadly, the more important features of an air ventilation system in order that the detailed description thereof that follows may be better understood and in order that the present contribution to the art may be better appreciated. There are, of course, additional features of the air ventilation system that will be described hereinafter and which will form the subject matter of the claims appended hereto.

In this respect, before explaining at least one embodiment of the air ventilation system in detail, it is to be understood that the air ventilation system is not limited in its application to the details of construction and to the arrangements of the components set forth in the following description or illustrated in the drawings. The air ventilation system is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present improved set of informational cards. It is important, therefore, that the claims be regarded as including such equivalent constructions insofar as they do not depart from the spirit and scope of the present invention.

It is therefore an object of the present invention to provide an air ventilation system, which has all of the advantages of the prior art and none of the disadvantages.

It is another object of the present invention to provide an air ventilation system which may be easily and efficiently manufactured and marketed.

It is another object of the present invention to provide an air ventilation system which is of durable and reliable construction.

It is yet another object of the present invention to provide an air ventilation system which is economically affordable and available for relevant purchasing government entities.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
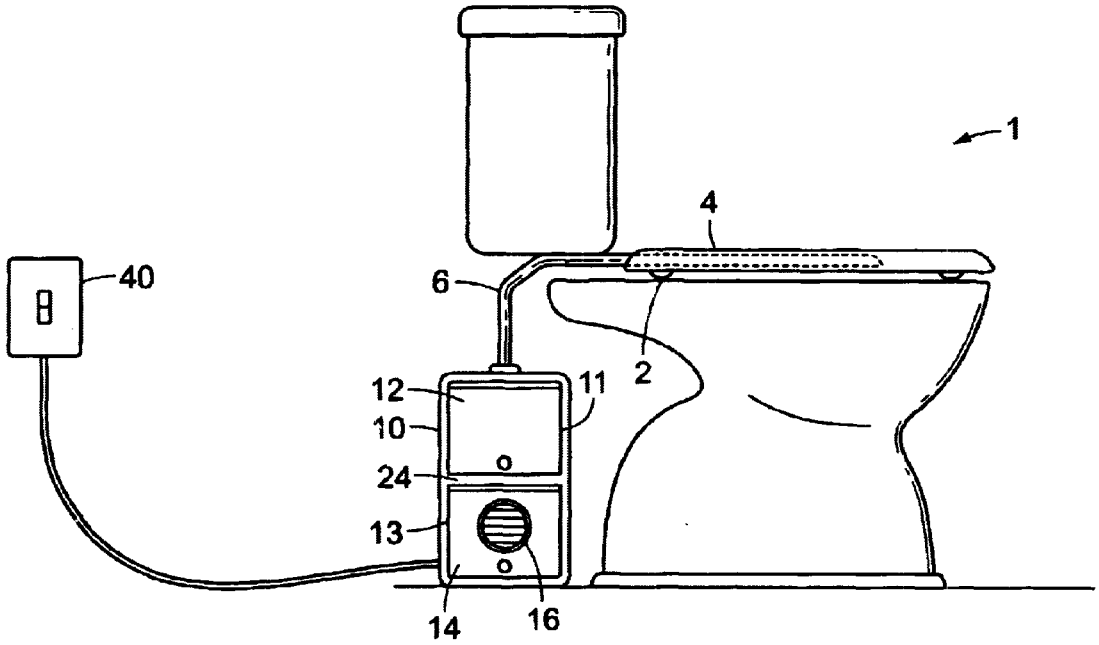
FIG. 1 shows a side view of the present invention attached to a toilet.

FIG. 1 shows a side view of the present invention attached to toilet 1. Ventilation exhaust line 6 can be seen as it winds from toilet seat 4 and eventually connects up to filter housing 10. Filter housing 10 is divided into two compartments, an upper compartment 11 and lower compartment 13, by divider membrane 24. Filter housing 10 has a front-mounted upper panel access door 12 which allows access to upper compartment 11 to exchange filters as needed, and also has a front-mounted lower panel access door 14 which allows access to lower compartment 13. Lower panel access door 14 also has front-mounted exhaust port 16 embedded on it. Lower panel access door 14 allows access to the motor located within the present invention.

In this diagram, seat switch 2 can also be seen. Seat switch 2 could include a spring-loaded electric switch which is normally open. When a person sits upon the seat, the weight of the person could compress seat switch 2 into a closed configuration. The electrical current then activates the fan motor, causing the motor of the present invention to engage and the present invention to operate. Alternatively, the electronic schematics of the present invention might be triggered by the light switch 40 or the fan switch alone and not be triggered by any electronics associated with the seat switch 2.

Figure 2:
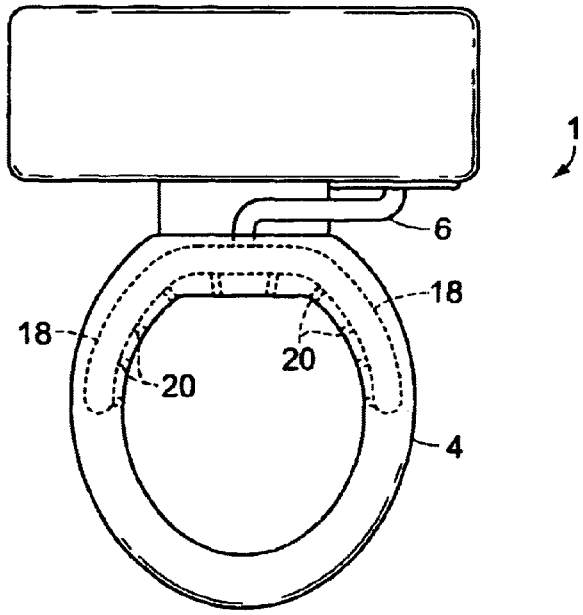
FIG. 2 shows a top view of a toilet seat with the present invention installed.

FIG. 2 shows a top view of toilet seat 4 of toilet 1 with the present invention installed. Ventilation exhaust line 6 can be seen connected to two ventilation pathways 18 located in the rear half of toilet seat 4. A plurality of small ventilation ports 20 allow air within the bowl to be sucked into the two ventilation pathways 18.

Figure 3:
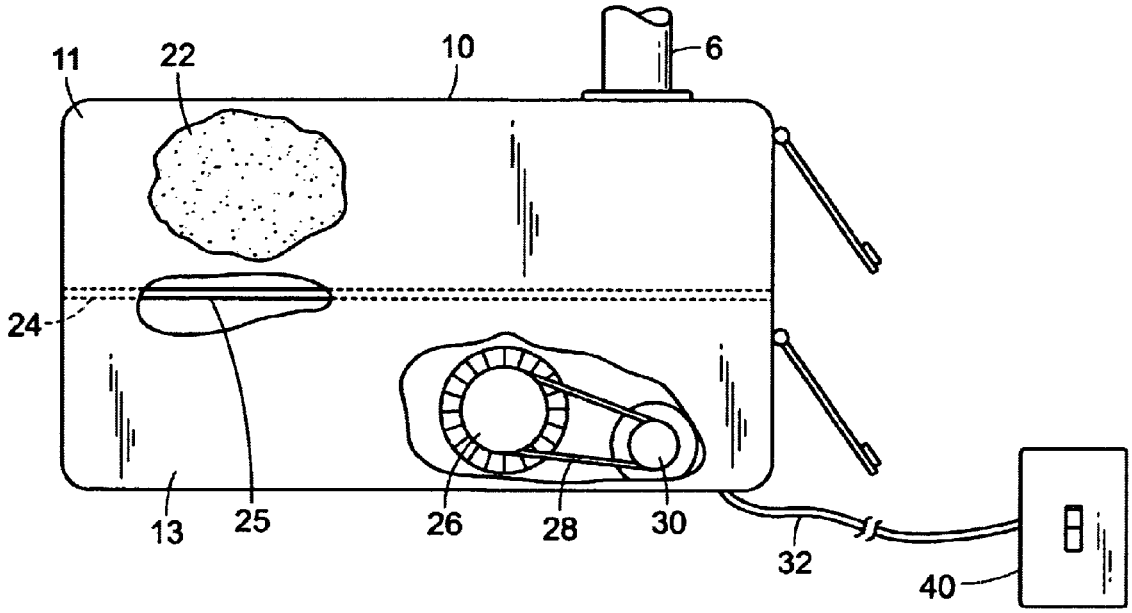
FIG. 3 shows a front view of the filtration system of the present invention.
Figure 4:
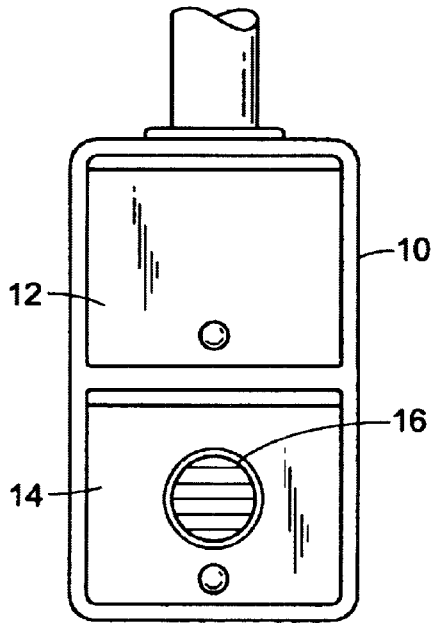
FIG. 4 shows a side view of the filtration system of the present invention.

FIGS. 3 and 4 show a side view and front view, respectively, of the filtration system of the present invention. Ventilation exhaust line 4 can be seen entering the top of filter housing 10. Within upper compartment 11, replaceable filter 22 is located. In addition, divider membrane 24, which divides upper compartment 11 with that of lower compartment 13, has a plurality of apertures 25 which serve as air passage ports between upper compartment 11 and lower compartment 13.

Air entering filter housing 10 enters via ventilation exhaust line 6 and passes through upper compartment 11. Then, it passed through replaceable filter 22, where the odor would be removed. After this, the air passes through apertures 25 into lower compartment 13. At this point, the air moves toward squirrel cage fan 26 and outward through exhaust port 16. Squirrel cage fan 26 is driven by flexible belt 28 connected to electric motor 30. Power cord 32 is connected to electric motor 30 to allow a user to choose to provide power to the present invention or to not use the present invention.

In some alternative embodiments of the present invention, power would be supplied to the present invention only when a wall switch, such as a bathroom light switch 40 or a bathroom fan switch, would be turned on. In these embodiments, the unit would not be activated if a user actually sat down on toilet seat 4, but did not turn on the light in the bathroom. However, the present invention would be activated by turning on the appropriate light or fan switch in the bathroom.

What I claim as my invention is:

1. An air ventilation system for a toilet comprising:

(a) a toilet, the toilet including a toilet seat and a toilet bowl, (b) a ventilation system which which would intake air within a toilet bowl and send the air through to a filtering system, (c) a filtering system for filtering air originally from within a toilet bowl, the filtering system further comprising a filter housing having two compartments, an upper compartment and a lower compartment, the filter housing having a divider located between the upper compartment and the lower compartment, the filter system further comprising an upper panel access door to allow a user to have access to the upper compartment within the filter housing, the filter system further comprising a lower panel access door to allow a user to have access to the lower compartment within the filter housing, the filter system further comprising a plurality of apertures located within the divider, the filter system further comprising an exhaust port located on the surface of the lower panel access door, the filter system further comprising a replaceable filter located within the upper compartment, the replaceable filter designed to filter air within the upper compartment before it travels through the plurality of apertures into the lower compartment, the filter system further comprising a squirrel cage fan located within the lower compartment, the squirrel cage fan designed to draw air within the upper compartment through the replaceable filter and the plurality of apertures into the lower compartment, the squirrel cage fan also designed to blow air within the lower compartment out the exhaust port located on the surface of the lower panel access door, the squirrel cage fan including a roller, and the filter system further comprising a means for rotating the squirrel cage fan, (d) activating means for starting the ventilation system and the filtering system, and (e) power means for supplying power to the ventilation system.

2. An air ventilation system for a toilet according to claim 1 wherein the means for rotating the squirrel cage fan further comprises:

(a) an electric motor connected to the power means, the electric motor located within the lower compartment, the electric motor including a roller, (b) a flexible belt attached to the roller on the electric motor and the roller on the squirrel cage fan, (c) whereby the electric motor, upon receiving adequate power supply from the power means, would rotate, thereby causing the flexible belt to rotate, thereby causing the squirrel cage fan to rotate, thereby creating a suction through which air would be drawn from the upper compartment to the lower compartment and on toward the exhaust port.

* * * * *